United States Patent [19]
Drillick

[11] 4,425,847
[45] Jan. 17, 1984

[54] TRAVELING PRESSURE PAD ASSEMBLY FOR MECHANICAL PRINTER APPARATUS

[76] Inventor: Jacob M. Drillick, 4560 South Cedar Lake Rd., Apt. No. 8, St. Louis Park, Minn. 55416

[21] Appl. No.: 381,397

[22] Filed: May 24, 1982

[51] Int. Cl.³ ..... B41F 3/16
[52] U.S. Cl. ..... 101/269; 101/270
[58] Field of Search ..... 101/45, 56, 269–274, 101/382 MV

[56] References Cited

U.S. PATENT DOCUMENTS

| | | | |
|---|---|---|---|
| 1,177,935 | 4/1916 | Dick | 101/270 |
| 1,801,594 | 4/1931 | Drydale | 101/274 |
| 3,730,088 | 5/1973 | Wood | 101/269 |
| 3,800,700 | 4/1974 | McInnis et al. | 101/269 |

*Primary Examiner*—Edward M. Coven
*Attorney, Agent, or Firm*—Orrin M. Haugen; Thomas J. Nikolai

[57] ABSTRACT

Apparatus for printing indicia upon a stationary paper surface and including a rotating pressure ring with the ring being held in a skate assembly having its surface normally forcing the paper to be printed against an ink retaining ribbon, or other character printing medium, and a printer such as a numbering machine. The rotating pressure ring is normally held within a carriage device or the like, such as a skate assembly which carries the rotatable ring. The skate assembly is normally mounted for movement along a backing plate or rail, and motion may be applied to the assembly through any convenient means, including hand motion, or motion achieved for the assembly through mounting upon an endless belt. The pressure ring is driven by means of a pair of rollers which engage the surface of a running rail, or backing plate and thereby provide rotational motion to the rotating pressure ring. The printer assembly of the present invention is particularly adapted for use with either mechanical lettering or numbering machines, as well as for imprinting of individual documents or the like.

3 Claims, 4 Drawing Figures

TRAVELING PRESSURE PAD ASSEMBLY FOR MECHANICAL PRINTER APPARATUS

BACKGROUND OF THE INVENTION

The present invention relates generally to a printing apparatus, and more specifically to a printing apparatus for imprinting characters onto a surface wherein the printing force is advanced across the surface being imprinted on a line-contact basis, and wherein a printing force is obtained through a rotating pressure ring driven or otherwise rotated by motion of the assembly carrying the pressure ring. In one application, the apparatus may be utilized to imprint characters on work in the form of a pre-printed paper web, it being understood, of course, that the printing apparatus may be utilized for any of a variety of printing operations wherein line-contact or serial advancing of the printing force is utilized across the surface being printed. In still another application of the printer apparatus of the present invention, a tape and ribbon lettering machine may utilize the printer apparatus to apply a working force to achieve the imprinting of a character onto a ribbon, utilizing an ink ribbon to transfer the indicia onto the tape.

In the printing arts, it is frequently desirable to utilize a printer apparatus which applies a force against a document to be printed, and wherein an ink ribbon is interposed between the surface to be printed and that of a numbering machine or the like. Numbering machines utilizing a plurality of rotatable or indexing rings are frequently utilized. The printing apparatus of the present invention is also adapted for use in connection with the printing of sequentially or otherwise specifically identified or numerically identified and arranged documents such as commercial checks, invoice forms, money orders, and the like. The individual documents are frequently and preferably pre-printed with the conventional information and indicia arranged thereon, with the exception being the imprinting of sequentially arranged numerical or alpha-numerical indicia or code. This type of printed document is available commercially in web form. The device of the present invention is intended for use by a printer to imprint numerical data onto the forms. In addition, the printing apparatus of the present invention may be utilized to apply magnetic ink to a document, such as a commercial check, or other type of business form.

The present invention provides a means for printing by means of a printing apparatus utilizing line-contact printing on the surface of the sheet being printed, without risking smudging of the surface, the pressure ring being rotated at a rate of speed which is substantially equal to the speed of the pressure ring across the surface being printed.

SUMMARY OF THE INVENTION

Briefly, in accordance with the present invention, an apparatus is provided for printing utilizing a pressure ring which is provided with rotational motion equal to the rate of speed of the printer across the surface being printed. While a number of applications for the printer apparatus of the present invention are contemplated, one such application is in connection with the printing of indexed sequentially arranged indicia, such as numerical indicia upon a continuous web, wherein means are provided for retaining a supply of the continuous web, in fan-fold configuration, along with a receiving means for the completed web, together with an imprinting ribbon. One such application is disclosed in my copending application executed on even date herewith and entitled "MECHANICAL PRINTER FOR NUMBERING CONTINUOUS FORMS" Ser. No. 381,398 filed May 24, 1982. In use with such apparatus, means are provided to receive and retain a continuous web, and with the apparatus including a web path defined between the paper supply zone (or reel) and paper receiving zone (or reel). Along the continuous web paths, one or more printing stations may be disposed, each of which includes a numbering machine with an array of numbering wheels. While the printer apparatus of the present invention may be driven by any of a variety of means, one such means is a belt assembly which is provided for each printing station, and which may carry a plurality of pressure skate assemblies thereon, each prepared in accordance with the present invention. Each pressure skate assembly of the present invention includes a pressure ring mounted for rotation therein. While other means of driving or carrying the pressure skate assembly may be utilized, an endless belt may be employed, with the endless belt being designed to carry each skate assembly in repeated excursions across a printing station so as to apply a printing force against the documentary and imprinting ribbon webs which are being held and moved in the zone between the surfaces of the pressure ring and the numbering machine.

An ink-impregnated transfer ribbon is preferably employed to imprint the characters onto the paper or other medium being printed. In an arrangement wherein an endless belt drive is utilized, the pressure applying skates of the present invention are preferably removably supported and/or mounted onto the endless belt. A force applying member is utilized to hold or otherwise retain the pressure applying skate against a rail or other guide surface. In certain applications, a magnetic member may be utilized to provide a substantially continuous and constant contact pull on the skate assembly to assure proper aligment of the pressure ring.

It is a primary object of the present invention to provide an improved apparatus for applying printing force upon a surface to be printed, and wherein the printing apparatus is provided with a means for moving the surface of a pressure ring at a rate equal to the rate of motion of the force applying device as it moves into the zone where the printing operation is accomplished.

It is a further object of the present invention to provide an improved apparatus for the application of printing force upon a surface being printed, wherein means are provided for providing continuous running motion to a pressure ring held within a pressure skate utilized to apply the printing force across the surface being printed.

It is a further object of the present invention to provide an improved apparatus for the printing of indicia upon a work surface and wherein the apparatus includes a means for delivering a substantially constant line-contact printing force to document and ink webs positioned or retained to contact lettering or numbering machines.

Other and further objects of the present invention will become apparent to those skilled in the art upon a study of the following specification, appended claims, and accompanying drawings.

IN THE DRAWINGS

DESCRIPTION OF THE PREFERRED EMBODIMENT

Figure 1:
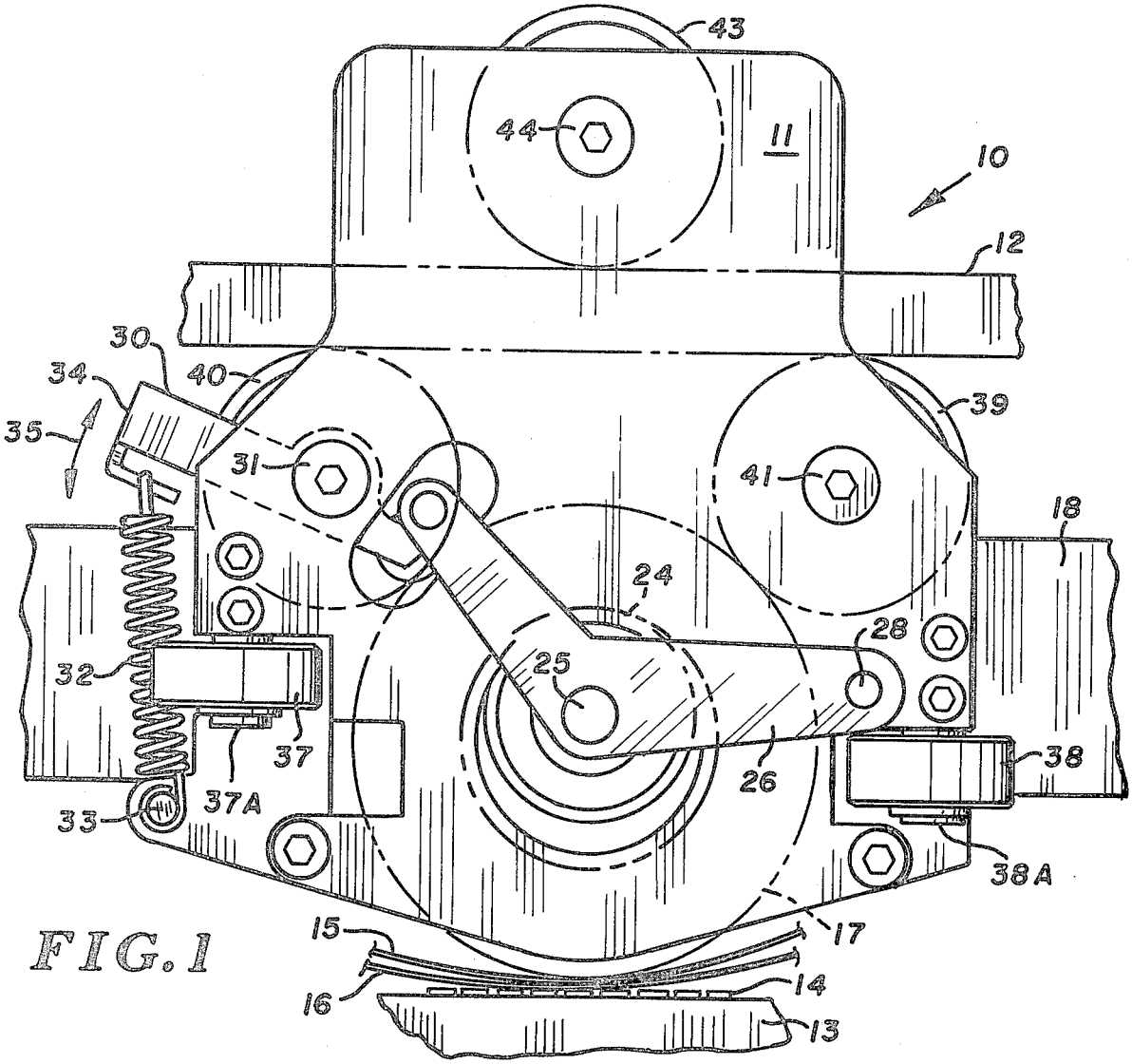
FIG. 1 is a top plan view of the printer apparatus of the present invention, and illustrating certain of the components in phantom, and further illustrating the device mounted upon a backing plate or running rail, and illustrating the disposition of a document to receive the printing, along with an ink-retaining ribbon.
Figure 2:
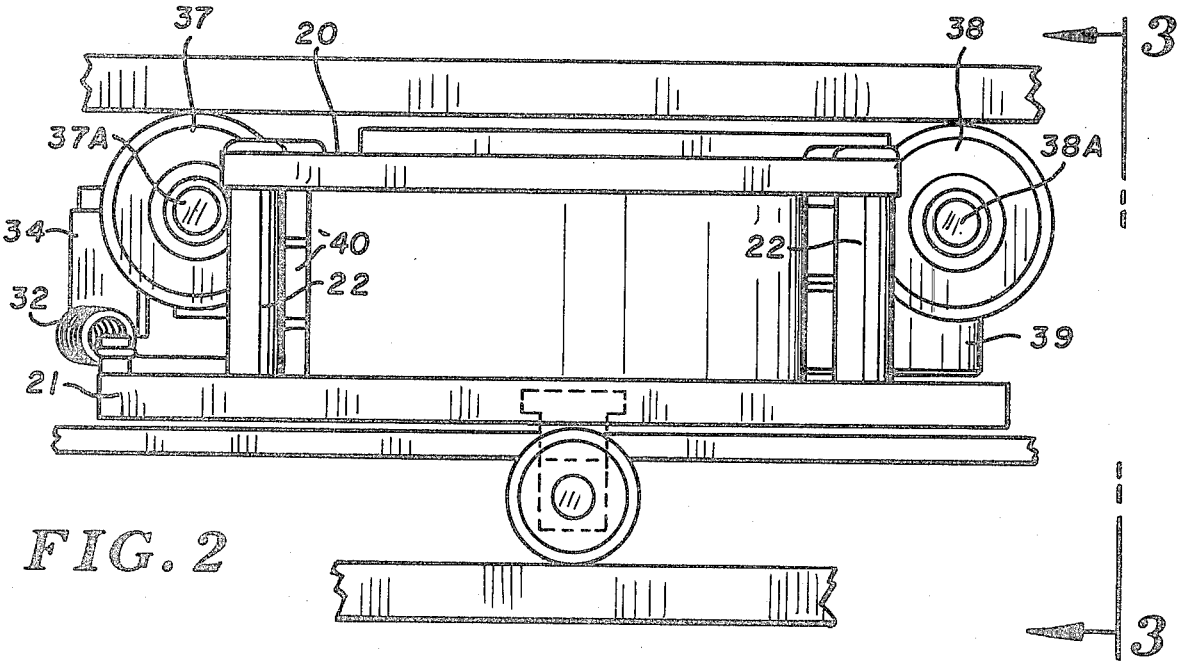
FIG. 2 is a side elevational view of the apparatus illustrated in FIG. 1, and further illustrating the surface of the pressure ring held within the assembly.
Figure 3:
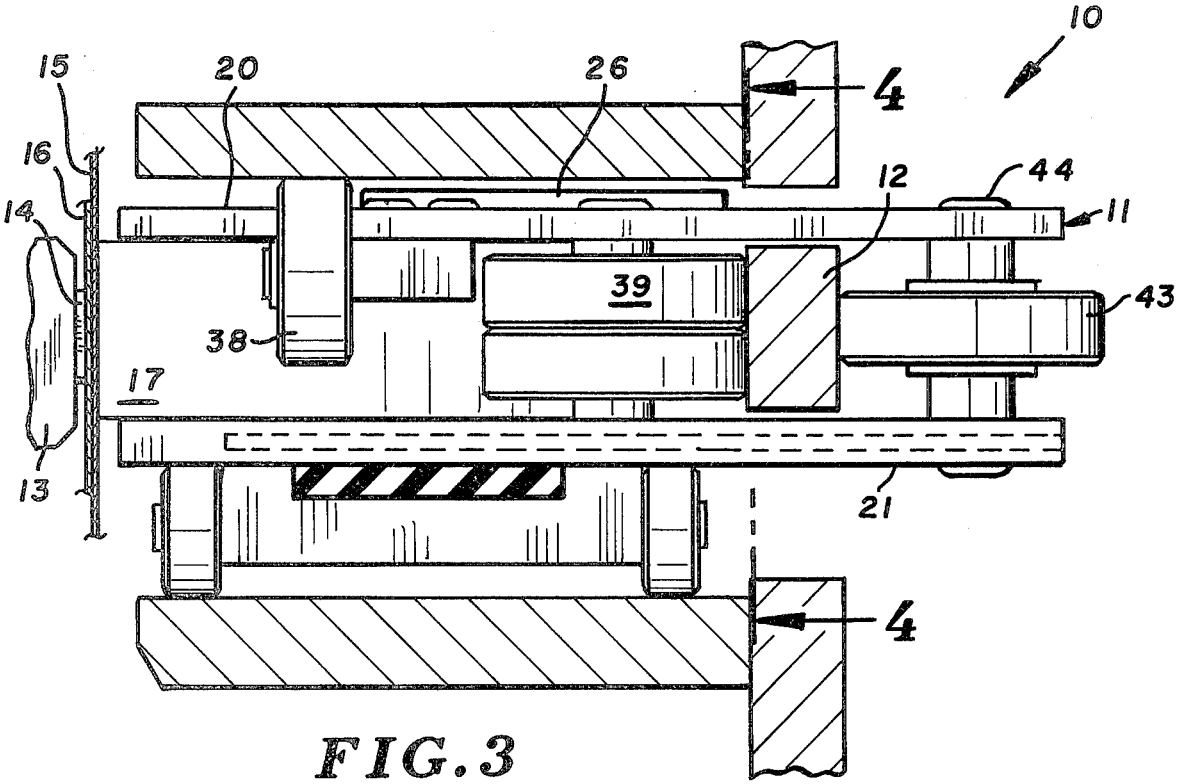
FIG. 3 is an end elevational view taken along the line and in the direction of the arrows 3—3 of FIG. 2.
Figure 4:
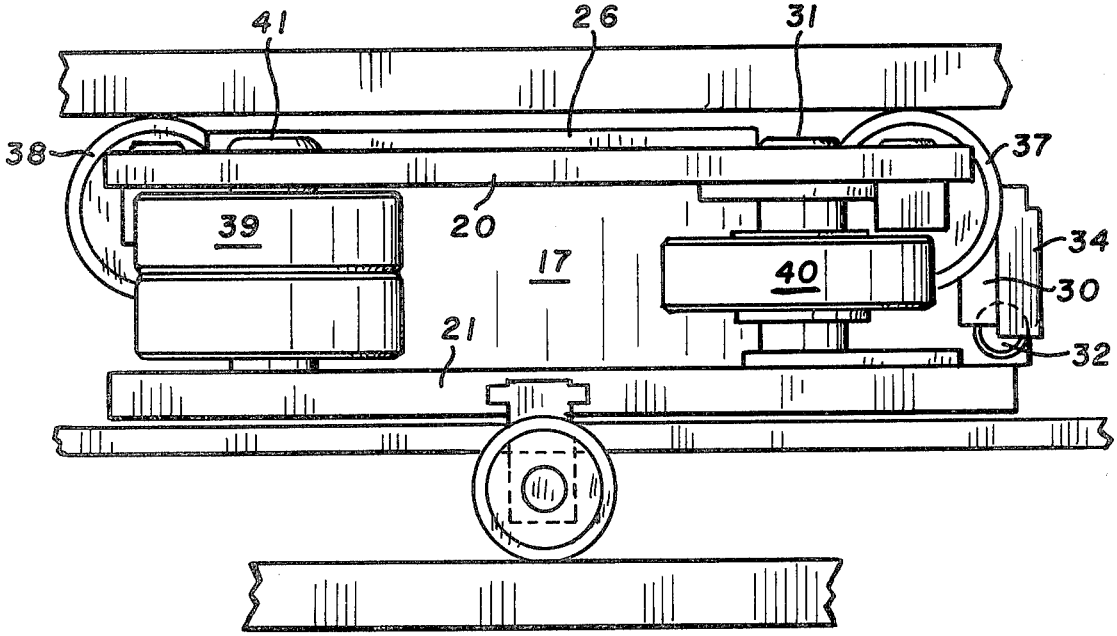
FIG. 4 is a side elevational view of the skate assembly of the present invention, and taken along the line and in the direction of the arrows 4—4 of FIG. 3.

In accordance with the preferred embodiment of the present invention, and with particular attention being directed to FIGS. 1 and 2 of the drawings, the printing apparatus generally designated 10 includes a pressure skate assembly generally designated 11, which is mounted upon a guide rail or the like 12. A numbering machine 13 is utilized to display the indicia to be imprinted, such as the raised printing characters 14—14. The paper to receive the printing is shown as at 15, with an ink-retaining ribbon being shown further at 16. Generally, the material to be printed, such as the paper 15, along with the ink-retaining ribbon 16 will be interposed between the surface of the pressure applying ring 17 and the surface of the characters to be imprinted as at 14. Suitable drive means are utilized to carry the assembly 11 along rail 12, with one such means being an endless drive belt such as is illustrated at 18.

The assembly 11 includes a pair of opposed framing plates 20 and 21, held together by through-bolts or screws as at 22—22. The assembly further includes means for mounting the pressure ring 17 therewithin, with ring 17 being held or mounted for rotation on idler puck 24. Idler puck 24 is, in turn, mounted for rotation about pin 25. Pin 25 is held within bell crank 26, with bell crank 26 being, in turn, mounted for pivotal rotation on plate 20 by means of pin 28. The free end of bell crank 26 is mechanically biased by means of lever 30 pivotally secured to plates 20 and 21 by means of pin 31. A spring 32 is utilized to provide this mechanical bias, with the end of spring 32 being secured to the plate 20 as at 33. The free end of spring 32 is coupled to link 34, with member 30 being free to move in the direction of the double-headed arrow 35 as is apparent.

Support bearings are provided for guiding the motion of the assembly 11, such as is shown at 37 and 38. Also, in order to provide for movement along the rail 12, a pair of wheels or bearings are provided as at 39 and 40. Bearings 39 and 40 are mounted for rotation within the frame defined by plates 20 and 21 through shafts or pins 31 and 41.

In order to provide a gripping force in the assembly onto rail 12, a counter bearing is provided as at 43, with counter bearing 43 being held within plates 20 and 21 by means of shaft 44. In each instance, bearings 39, 40 and 43 are journaled for rotation about their respective pin support members. Also, bearings 37 and 38 are mounted for journaled rotation along their respective support pins or shafts as illustrated at 37A and 38A.

The running surface of bearings 39 and 40 make contact with the surface of pressure ring 17, and cause rotation of ring 17 at a rate equal to the rate of travel of the entire assembly. Thus, as the assembly 11 moves along rail 12, the surface of pressure ring 17 will move at a rate equal to the rate of motion of the entire assembly. This movement prevents scuffing to occur between the surface of the work 15 and the ink-retaining ribbon 16, as these two items or elements are forced against the raised surfaces of elements 14.

Preferably, the pressure ring 17 is in the form of a modified torus, with the interior periphery being held for rotation of the entire torus within the assembly. It will be appreciated that any of a variety of means may be employed to drive the assembly along its guide rail, such as rail 12, with manual forces being available for applying such motion, as well as mechanical forces such as may be achieved from an endless belt or the like.

I claim:

1. Apparatus for applying printing forces upon a surface to be printed and comprising, in combination:

(a) a main frame, guide rail means, and force applying means mounted upon said guide rail, said force applying means including traveling frame means for said printing force applying apparatus;

(b) first and second drive bearing means rotatably journaled for rotation about first and second axes respectively within said traveling frame means, and arranged to normally contact the surface of said guide rail to impart rotation to said drive bearing means;

(c) pressure ring means mounted for rotation within said traveling frame means, with said pressure ring means being rotatably journaled for floating rotation generally about idler puck means rotatably journaled on a third axis, said first and second axes being disposed on opposite side of said third axis and intermediate said third axis and said guide rail means, with the peripheral surface of said pressure ring being arranged in running contact with the periphery of said drive bearing means; and (d) mechanical bias means for normally forcing the outer surface of said pressure ring means into contact with the periphery of said drive bearing means so as to impart rotational motion to said pressure ring prior to contact being established between said pressure ring and the surface to be printed.

2. The apparatus as defined in claim 1 being particularly characterized in that said traveling frame means is secured to an endless drive belt and driven along an orbital path by said belt.

3. The apparatus as defined in claim 1 being particularly characterized in that spring bias means are provided for said idler puck and third axis for maintaining said drive bearing means in continuous running contact with the surface of said guide rail means.

* * * * *